United States Patent [19]

Stauers et al.

[11] 4,237,789

[45] Dec. 9, 1980

[54] PROGRAMMABLE FUZE FOR PROJECTILES

[75] Inventors: Juris Stauers, Tempe; Vincent R. Alfaro, Mesa, both of Ariz.

[73] Assignee: Motorola, Inc., Schaumburg, Ill.

[21] Appl. No.: 946,484

[22] Filed: Sep. 28, 1978

[51] Int. Cl.[3] ..... F42C 11/00; F42C 19/00

[52] U.S. Cl. ..... 102/270; 102/206; 102/265

[58] Field of Search ..... 102/265, 270, 215, 206

[56] References Cited

U.S. PATENT DOCUMENTS

| | | | |
|---|---|---|---|
| 3,628,458 | 12/1971 | Sands | 102/265 |
| 3,750,588 | 8/1973 | Nordgren | 102/270 |
| 3,777,665 | 12/1973 | Ziemba | 102/215 |
| 3,922,534 | 11/1975 | Gerstenmeier et al. | 235/151.32 |
| 3,976,012 | 8/1976 | Nordgren | 102/270 |
| 4,142,442 | 3/1979 | Tuten | 102/215 |

*Primary Examiner*—Charles T. Jordan

*Attorney, Agent, or Firm*—Eugene A. Parsons

[57] ABSTRACT

A fuze for projectiles having electronic circuitry therein for receiving radiated signals having a fusible link connected to the electronic circuitry for altering the operation of the electronic circuitry and a threshold detector for sensing the rupture of the link to place the fuze in a first mode of operation when the link is ruptured prior to firing of the projectile and in a second mode of operation when the link is ruptured within a predetermined time period subsequent to firing of the projectile.

12 Claims, 4 Drawing Figures

PROGRAMMABLE FUZE FOR PROJECTILES

BACKGROUND OF THE INVENTION

In all prior art fuzes, each fuze is constructed to operate in a single mode, i.e., proximity, impact, etc. In almost all projectile fuzes, safing and arming mechanisms are utilized and, in some instances, short circuit connections, or links, are utilized to prevent premature firing. Such a short circuit connection is described in U.S. Pat. No. 4,062,290, entitled "Electrical Fuze For Projectiles" and issued Dec. 13, 1977. Also, direct contact fuze setters, inductive fuze setters and RF fuze setters are utilized. However, none of these features are utilized to provide a plural mode, remotely programmable fuze.

SUMMARY OF THE INVENTION

The present invention pertains to a programmable fuze for projectiles wherein the fuze includes electronic circuitry for providing first and second modes of operation and a fusible electrically conducting link is provided in conjunction with the electronic circuitry for placing the fuze in a first mode of operation when the link is ruptured prior to firing of the projectile and in a second mode of operation when the link is ruptured within a predetermined time period subsequent to firing of the projectile.

It is an object of the present invention to provide a new and improved programmable fuze for projectiles.

It is a further object of the present invention to provide a new and improved programmable fuze for projectiles which is remotely programmable.

It is a further object of the present invention to provide a programmable fuze for projectiles having a fusible link therein and electronic circuitry for sensing the rupture of the link to set the fuze to a first mode of operation when the link is ruptured prior to firing of the projectile and to a second mode of operation when the link is ruptured within a predetermined time period subsequent to the firing of the projectile.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the Figures.

DESCRIPTION OF THE PREFERRED EMBODIMENT

Figure 1:
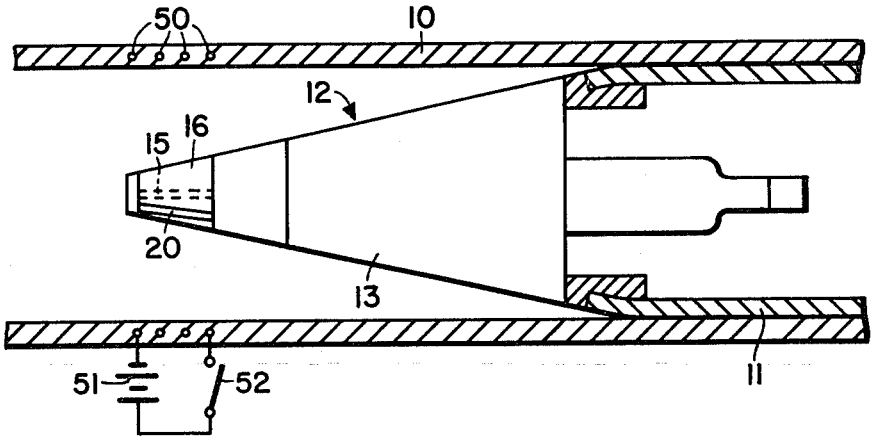
FIG. 1 is a sectional view of a fuze and projectile incorporating the present invention and situated in a gun barrel in firing position, portions thereof broken away.

Referring specifically to FIG. 1, the numeral 10 indicates a barrel designed to fire a projectile, generally designated 11. The projectile 11 has a fuze 12 affixed to the forward end thereof, which fuze is programmable in accordance with the present invention. The fuze 12 includes a body portion 13 containing the electronics and other operating portions of the fuze, which do not form a portion of this invention and will not be explained herein, and a forwardly projecting antenna 15 encapsulated in a nonconducting material 16 which provides the fuze 12 with the proper contours without affecting the operation of the antenna 15. A fusible link 20 is affixed to the outer surface of the material 16 and connected between the antenna 15 and the body 13 to short the antenna 15 and alter the loading effect thereof while the link 20 is intact.

Figure 2:
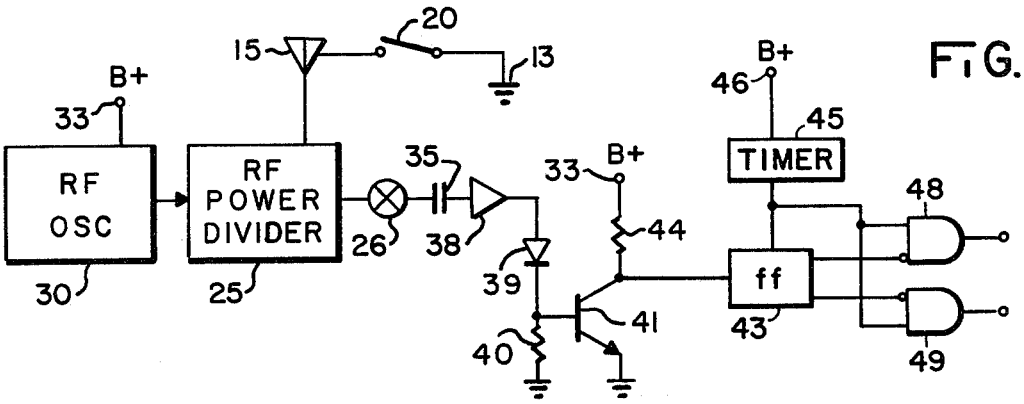
FIG. 2 is a schematic block diagram of electronic circuitry located in the fuze of FIG. 1 and embodying the present invention.

Referring to FIG. 2, the electronics associated with the antenna 15 and the fusible link 20 are illustrated schematically. In FIG. 2, the fusible link 20 is schematically shown as a normally closed single pole switch having one contact grounded, or attached to the body 13, and the other contact coupled to the antenna 15. The antenna 15 is coupled to an input/output of an RF power divider 25. A second input of the divider 25 is connected to an output of an RF oscillator 30. The RF oscillator 30 receives power from a source (not shown) on a terminal 33. It should be understood that the oscillator 30 and divider 25 are shown in greatly simplified block form since they do not actually form a part of this invention and are only included for purposes of this explanation. The purpose of the divider 25 is to convey most of the power from the oscillator 30 to the antenna 15 for transmission and to convey a portion of the power of the oscillator 30 to an output of the divider for use as a local oscillator signal. The output of the divider 25 is applied to a mixer 26, which may be for example a diode. While a variety of RF configurations might be utilized, the present embodiment is illustrated for its simplicity. The terminal 33 is adapted to receive a positive voltage from the source that supplies voltage to the remainder of the electronics for the fuze 12, which generally consists of a battery that is activated after set back and spin (or firing) of the projectile 11. Voltage sources of this type are well known in the art and will not be described in detail herein.

The output of the mixer 26 is connected through a coupling or DC blocking capacitor 35 to an amplifier 38. The output of the amplifier 38 is connected to the anode of diode means 39 (this may be one or more diodes connected in series, depending upon the amount of voltage drop or threshold required), the cathode of which is connected through a resistor 40 to ground. The cathode of diode 39 is also connected to the base of an N-P-N type transistor 41, the emitter of which is connected to ground and the collector of which is connected through a resistor 44 to the positive voltage terminal 33. The collector of the transistor 41 is also connected to the input of a binary element, such as flip-flop 43. The diode means 39, resistors 40 and 44 and transistor 41 form a threshold detector for sensing a change in the DC voltage at the output of the amplifier 38. A timer 45, which is activated by the application of a voltage (such as the battery described above) to a terminal 46, supplies a signal to the reset terminal of the flip-flop 43. The timer 45 also supplies a signal for a predetermined interval, subsequent to firing of the projectile 11, to a pair of coincidence gates 48 and 49. One output of the flip-flop 43 is connected to a second input of the coincidence gate 48 and a second output of the flip-flop 43 is connected to a second input of the coincidence gate 49.

In the operation of the circuit of FIG. 2, when the link 20 is intact (shorting antenna 15) the antenna 15 is mismatched and reflects most of the power applied thereto back through the divider 25 to the mixer 26. The mixer half-wave rectifies the RF signal and provides a high DC signal which is blocked by the capacitor 35. The link 20 can be fused or ruptured prior to firing of the projectile 11 by forced heating (such as from a prior fired projectile) or by use of a heating element, such as illustrated in FIG. 1. The heating element of FIG. 1 consists of a plurality of loops of wire 50 fixedly positioned in the barrel 10 and energized by means of a voltage source 51 connected through an external switch 52. The coils 50 are positioned so as to be adjacent the fusible link 20 when the projectile 11 is correctly positioned in the barrel 10. While this relatively simple method of rupturing the link 20 is illustrated, it should be understood that any other method of rupturing the link 20 prior to firing of the projectile might be utilized.

If the link 20 is ruptured prior to firing of the projectile 11, the oscillator 30, divider 25, mixer 26 and antenna 15 operate in a normal manner once set back and spin provide power to the positive terminal 33. The power will also activate the timer 45 and, even if a signal is inadvertently applied to the flip-flop 43, it will not be applied during the predetermined interval (produced by the timer 45) subsequent to firing. The timer 45 will reset the flip-flop 43 (to ensure that it is in the correct state) prior to the application of the predetermined time period signals to the coincidence gates 48 and 49. Thus, once the predetermined time period signals from the timer 45 are applied to the coincidence gates 48 and 49, the output from the flip-flop 43 to the gate 49 will cause an output therefrom, which will place the fuze 12 in a first mode of operation. This first mode of operation may be, for example, operation upon impact.

Figure 3:
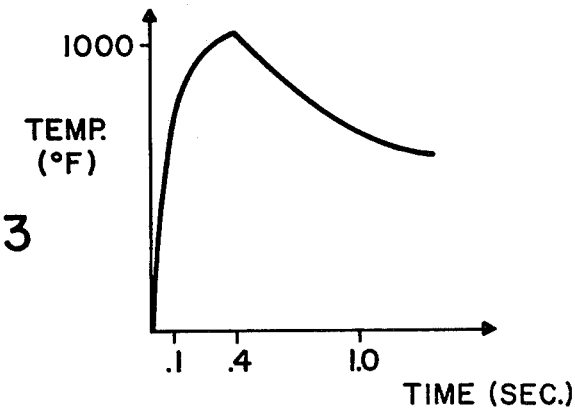
FIG. 3 is a temperature versus time graph approximating the aeroheating of the fuze subsequent to firing of the projectile.
Figure 4:
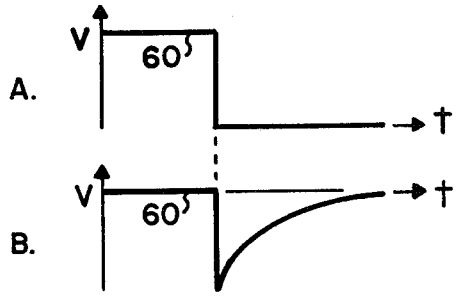
FIG. 4 illustrates two approximate voltage waveforms present in the circuitry illustrated schematically in FIG. 2.

If the switch 52 of the heating element is not operated prior to firing of the projectile 11, the fuse 12 will undergo aeroheating during flight which corresponds approximately with the graph illustrated in FIG. 3. The link 20 is designed to fuse or rupture from the effects of the aeroheating of the fuze 12 within a predetermined time subsequent to the firing of the projectile 11, generally coinciding with the predetermined time signals provided by the timer 45. Once the projectile 11 is fired and the oscillator 30 and timer 45 have a positive voltage applied thereto, the voltages at the antenna 15 and at the input to the amplifier 38 appear as illustrated in the first portion, designated 60, of the waveforms of FIG. 4*a* and FIG. 4*b*, respectively. Upon the rupture of the link 20 by aeroheating, the antenna 15 becomes properly matched and the reflected power drops to near zero, dropping the DC voltage out of the mixer 26 sharply. This sharp drop in DC voltage will pass through the capacitor 35 and be inverted by the amplifier 38 to appear as a sharp positive pulse at the diode 39. Under these conditions the pulse should be high enough to overcome the bias produced by the diode means 39 and drive the transistor 41 into saturation. Other signals, such as noise, etc., which might get through the capacitor 35 will generally not be high enough to overcome the bias of the diode means 39 and, thus, will not turn on the transistor 41. When the transistor 41 saturates a negative pulse will be applied to the flip-flop 43. The flip-flop 43 will change states and, if the rupturing of the link 20 occurs during the predetermined time period set into the timer 45, the output of the flip-flop 43 and the output of the timer 45 will coincide to cause the gate 48 to produce an output which will place the fuze 12 in a second mode of operation, which may be for example proximity operation.

Thus, a programmable fuze 12 is illustrated which may be remotely operated to function in first or second modes. The actual circuitry for switching between modes in response to the rupture of the link 20 is simplified for convenience of explanation and circuitry actually causing the modes of operation, in response to signals from gates 48 or 49, is not illustrated because it does not form a portion of this invention. However, typical circuitry illustrating different modes of operation is described in a copending application entitled "Electronic Time Delay Safety and Arming Mechanism", Ser. No. 843,621, filed Oct. 19, 1977, now U.S. Pat. No. 4,145,971. While we have shown and described a specific embodiment of this invention, further modifications and improvements will occur to those skilled in the art. We desire it to be understood, therefore, that this invention is not limited to the particular form shown and we intend in the appended claims to cover all modifications which do not depart from the spirit and scope of this invention.

We claim:

1. A programmable fuze for a projectile, including an antenna projecting outwardly from said fuze, comprising a heat fusible electrically conducting link fixedly connected in shorting engagement to said antenna and fusible by aeroheating subsequent to firing of the projectile.

2. A programmable fuze as claimed in claim 1 wherein the fusible link is situated in juxtaposition to the outer surface of the fuze and extends axially therealong.

3. A programmable fuze as claimed in claim 1 including in addition electronics coupled to said fusible link for sensing the rupture of said link and providing a first mode of operation for the fuze when the link is ruptured prior to firing the projectile and a second mode of operation for the fuze when the link is ruptured subsequent to firing the projectile.

4. In a programmable fuze, a threshold detector for sensing a step voltage comprising:

(a) semiconductor means having an input and an output and coupled to a source of supply for providing a first level of output signal when said semiconductor means is activated by an input signal and a second level of output signal when said semiconductor means is deactivated; and (b) input means coupled to the input of said semiconductor means and including diode means adapted to receive an input signal and supply the input signal to the input of said semiconductor means when the input signal exceeds a predetermined threshold.

5. A threshold detector for a programmable fuze as claimed in claim 4 wherein the semiconductor means includes an N-P-N type transistor with a base element connected as the input and a collector element providing the output.

6. A threshold detector for a programmable fuze as claimed in claim 5 wherein the input means includes resistance means coupled between the base element of the transistor and an emitter element of said transistor, and at least one semiconductor diode connected to the base element of said transistor and adapted to receive an input signal.

7. A programmable fuze for projectiles comprising:

(a) electronic means for providing a normal output voltage;

(b) a fusible link connected to said electronic means for altering the normal output voltage thereof, said link being positioned to be fusible by means external to the fuze; and (c) electronic sensing means positioned within the fuze and coupled to said electronic means for sensing a charge in the output voltage from the altered to the normal state indicating a rupture of said link and providing a signal indicative of the rupture.

8. A programmable fuze as claimed in claim 7 wherein the fusible link is positioned in juxtaposition to the outer surface of the fuze.

9. A programmable fuze as claimed in claim 7 wherein the electronic means includes an antenna and the link is connected to inactivate said antenna for altering the power reflecting characteristics thereof.

10. A programmable fuze as claimed in claim 9 wherein the electronic sensing means includes a threshold detector coupled to the antenna and providing a first output signal when the power reflecting characteristics of the antenna are altered and providing a second output signal when the power reflecting characteristics of the antenna are unaltered.

11. A programmable fuze as claimed in claim 10 wherein the fuze has first and second modes of operation and the electronic sensing means includes timing means constructed to be activated upon firing of the fuze for placing the fuze in the first mode of operation when the link is ruptured prior to firing and placing the fuze in the second mode of operation when the link is ruptured within a predetermined time period subsequent to firing.

12. A programmable fuze as claimed in claim 7 including in addition actuateable means positioned within a gun barrel adapted to fire the fuze and projectile for rupturing the fusible link prior to firing the fuze and projectile.

* * * * *